US006308370B1

(12) United States Patent
Southby

(10) Patent No.: US 6,308,370 B1
(45) Date of Patent: Oct. 30, 2001

(54) ADHESIVE SPREADER

(75) Inventor: Roydon Charles Southby, 25 Doradus Avenue, Hope Valley, South Australia, 5090 (AU)

(73) Assignees: Roydon Charles Southby; Dixie Gaye Southby Partnership, both of Hope Valley (AU)

( * ) Notice: Subject to any disclaimer, the term of this patent is extended or adjusted under 35 U.S.C. 154(b) by 0 days.

(21) Appl. No.: 09/241,716

(22) Filed: Feb. 2, 1999

(30) Foreign Application Priority Data

Feb. 2, 1998 (AU) ..... PP 1609
Aug. 26, 1998 (AU) ..... PP 5454

(51) Int. Cl.[7] ..... B05C 17/10
(52) U.S. Cl. ..... 15/245.1; 15/235.6; 15/235.8; 15/236.08
(58) Field of Search ..... 15/235.4, 235.5, 15/235.6, 235.8, 236.08, 245.1

(56) References Cited

U.S. PATENT DOCUMENTS 2,008,952 * 7/1935 Gach ..... 15/245.1
2,081,735 * 5/1937 Caronia ..... 15/245.1
2,806,240 * 9/1957 Cottar ..... 15/245.1
2,913,753 * 11/1959 Peterson ..... 15/245.1
3,119,138 * 1/1964 Davis ..... 15/245.1
4,080,684 * 3/1978 Venditti ..... 15/245.1
5,379,479 * 1/1995 Nelson ..... 15/245.1
5,606,763 * 3/1997 South et al. ..... 15/245.1
5,778,482 * 7/1998 Sbrigato ..... 15/245.1

FOREIGN PATENT DOCUMENTS

1577936 * 10/1980 (GB) ..... 15/245.1

* cited by examiner

*Primary Examiner*—Mark Spisich
(74) *Attorney, Agent, or Firm*—Brown, Martin, Haller & McClain, LLP

(57) ABSTRACT

A spreader for use in spreading a bed of predetermined thickness of adhesive material on a prepared floor surface prior to the laying of tiles. The spreader comprises a rectangular planar portion (2) having a serrated lower longitudinal edge (4) and flanges (6 and 8) extending substantially at right angles from the transverse edges of the rectangular planar portion (2). The flanges provide a barrier allowing a mass of adhesive to lie in front of the serrated edge (4) and between the flanges (6 and 8) as the spreader is drawn over the surface of the surface to be tiled. As the spreader is drawn over the surface the adhesive flows under the serrated edge thereby providing an even application of adhesive across the full width of the spreader. A height adjuster comprising an adjustable gauge (28) is provided as is a handle (10) or elongate handle (50) for convenient use by the tiler.

6 Claims, 6 Drawing Sheets

ADHESIVE SPREADER

This invention relates to improvements in adhesive spreaders, and particularly to spreaders used to apply adhesive for tiles and in particular ceramic tiles.

BACKGROUND OF THE INVENTION

Tiles are typically laid on a clean prepared supporting surface by spreading adhesive over that surface with a trowel or alternatively a flat elongate sheet having serrations along a spreading edge. A skilled tradesperson will apply sufficient adhesive over the required area as well as attempt to provide an even height of adhesive so that the tile is evenly supported and becomes securely fixed as the adhesive hardens.

Too thin a coverage of adhesive (caused by the spreader being angled forwards or backwards) may result in adjacent tiles having different heights which may then be dangerous to walk upon and which may lead to breakage of the edges of the higher tile. Furthermore, uneven support of a tile can lead to tile breakages at the boundary between the adequate support and the inadequate support beneath the tile.

Tradespersons sometimes lay tiles with a predetermined slope which can be skilfully created by sloping the upper surface of the adhesive (by progressively leaning the spreader forward or backwards) over an otherwise level supporting surface, and then laying each tile with the required slope. This requires great dexterity, judgement and trade skill.

Furthermore, the spreading of adhesive over large areas also requires great skill and consistency so that the previously mentioned problems are not created.

The present invention will result in the reduction or elimination of the problems of inconsistently applied skills and provide a useful tool for use by tilers who may then be in a position to better apply other skills associated with the laying of tiles.

BRIEF DESCRIPTION OF THE INVENTION

A broad aspect of the invention for an adhesive spreader tool for spreading tile adhesive over an underlaying floor surface comprising:

- a rectangular planar portion forming a rear wall having a plurality of indentations along a lower longitudinal edge,
- a pair of opposing side walls extending substantially at right angles from rear wall,
- wherein said flanges provide a sideways barrier for a mass of adhesive lying in front of said rear wall such that as the spreader tool and adhesive is drawn across said floor surface a supply of adhesive is spread over said surface as it flows through said indentations providing an application of adhesive across the full width of the spreader tool.

The flanges may be used while abutting a straight edge so as to guide the spreader tool across an area to be laid with tiles. Preferably the spreader is at least a single tile width but may be of a multiple tile width so that a line of tiles may be laid over the area of prepared adhesive.

In a further aspect of the invention an adhesive spreader in accordance with the broad aspect described above is provided with a height adjuster means comprising:

- a gauge surface adjustable up and down the height of at least one of said flanges such that when said gauge surface is located on a guide located adjacent said floor surface to be tiled said spread adhesive has a maximum height which is a predetermined distance from said gauge surface.

Specific embodiments of the invention and methods of its use will now be described in some further detail with reference to and as illustrated in the accompanying figures. These embodiments are illustrative, and not meant to be restrictive of the scope of the invention. Suggestions and descriptions of other embodiments may be included, but they may not be illustrated in the accompanying figures, or alternatively features of the embodiments may be included in the figures but not described in the specification.

DETAILED DESCRIPTION OF EMBODIMENTS OF THE INVENTION

Figure 1:
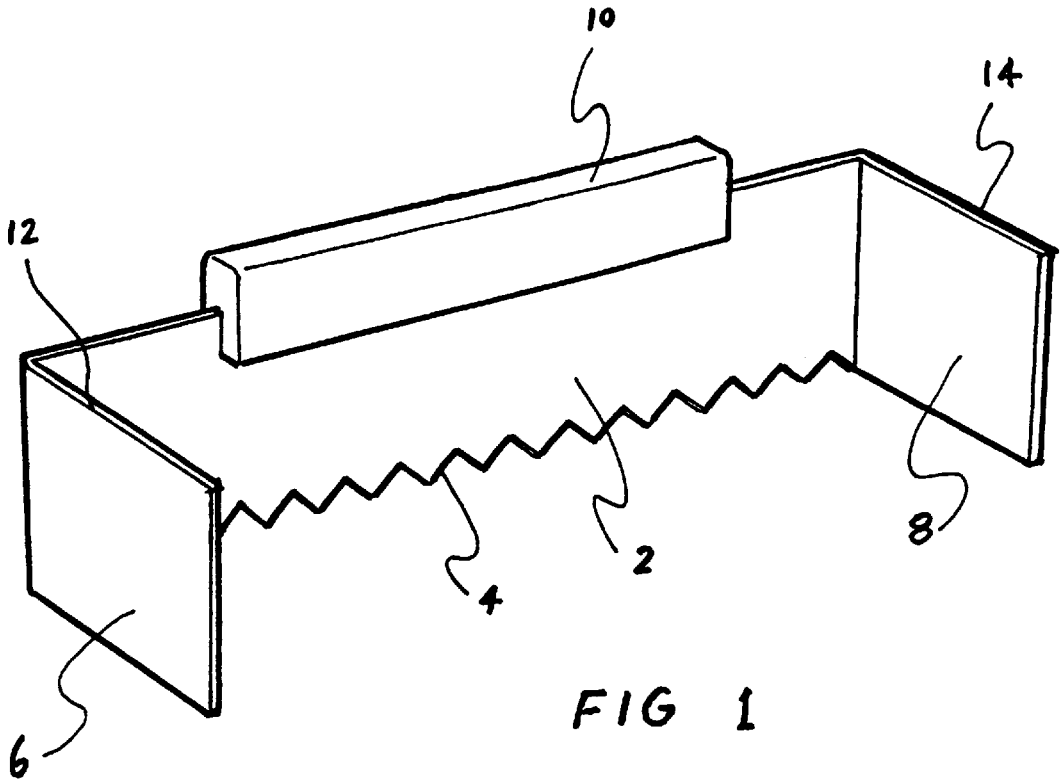
FIG. 1 shows a front perspective view of an adhesive spreader according to one embodiment of the invention.

FIG. 1 depicts a rectangular planar portion 2 having a plurality of indentations 4 along a bottom longitudinal edge and flange portions 6 and 8 which extend substantially at right angles from the transverse edges of the planar portion 2. The height of the planar portion 2 is made sufficient to hold a manageable volume of adhesive in front of the indentations 4 and the actual amount that can be held and consequently spread is dependent on the size and configuration of the flange portions 6 and 8.

Since it is preferable to spread enough adhesive for more than one tile at a time, the width of the longitudinal edge of the rectangular portions is at least the width of a tile, and if of sufficient retaining capacity the spreader can be drawn along the level prepared surface upon which the tiles are to be laid, at least the length of one or more tiles.

Flanges 6 and 8 are ideally positioned at right angles to the planar portion 2. The outermost surfaces 12 and 14 of each flange can thus be abutted against guides or previously laid tiles so as to lead the adhesive spreader across the surface upon which the tiles are to be laid.

The planar and flange portions of the spreader can be of light strong material such as aluminium or sheet steel, but other material such as plastics, wood etc may also be suitable.

The height of the indentations determines the height of the adhesive which is spread over the surface, and the shape is a matter of preference or determined by the manufacturer of the tiles to be laid. In this embodiment serrations are used but castellations on other shapes of indentations could be used. Not surprisingly though, the crests of the spread adhesive are flattened by the bottom surface of the tile when it is laid, and the adhesive spreads across the bottom surface of the tile placed upon it.

The preferred serrated profile of the spread adhesive allows air to expel as the tile is laid upon the adhesive.

An optional handle 10 is shown fixed to the upper longitudinal edge of the rectangular planar portion 2.

Figure 2:
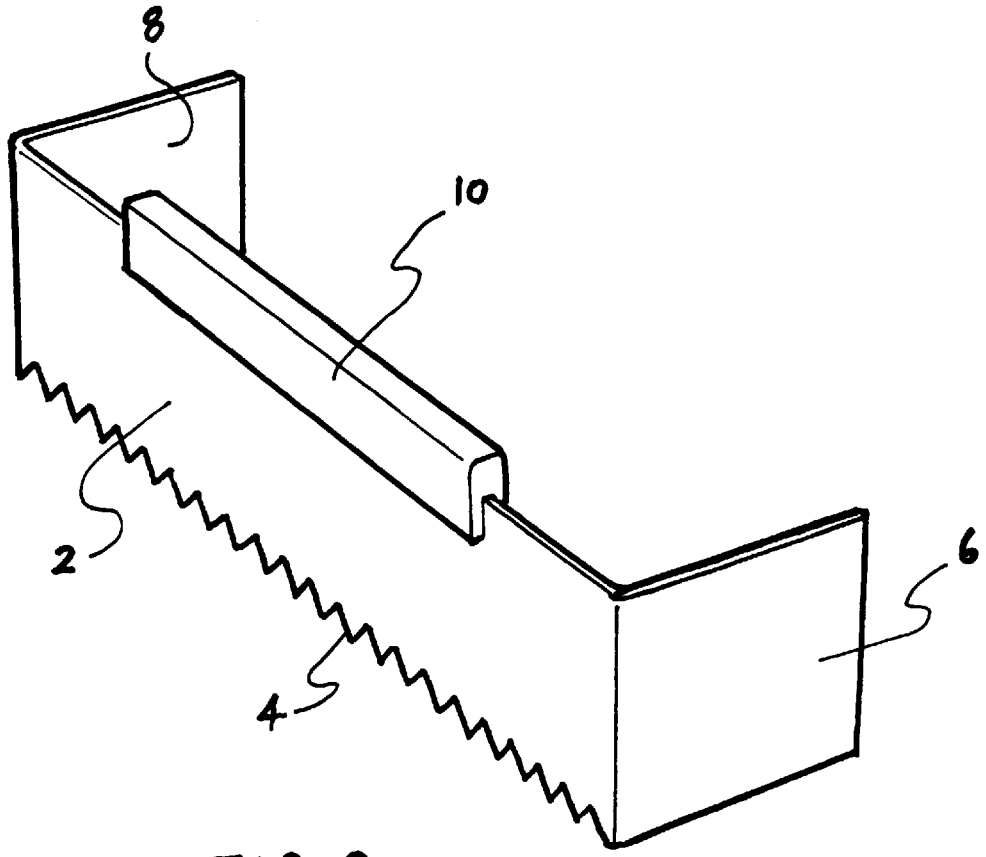
FIG. 2 depicts a rear perspective view of the embodiment disclosed in FIG. 1.

FIG. 2 shows a rear view of the embodiment depicted in FIG. 1 where like elements are like numbered.

Figure 3:
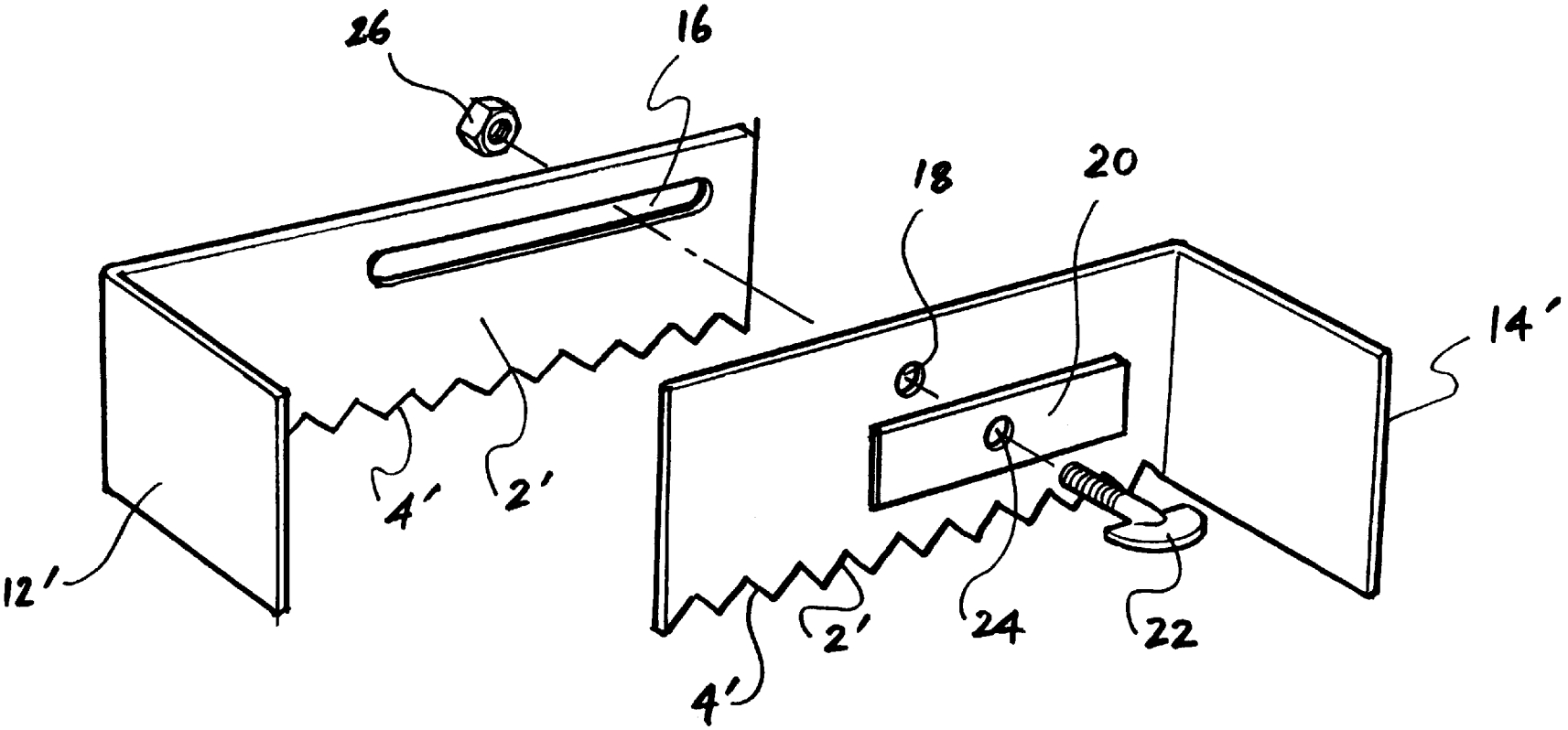
FIG. 3 depicts first and second portions of a second embodiment of an adhesive spreader.

FIG. 3 shows the component portions of a variable width adhesive spreader which is not shown in its constructed state.

Such an arrangement is but one further embodiment of the invention which can be arranged to be sized to spread adhesive for a variety of tile widths or an even multiple width of a tile.

The left side of an adhesive spreader depicted in FIG. 3 comprises a rectangular planar portion 2' having serrations 4' in its lower longitudinal edge, and the longitudinal slot 16 is arranged about two-thirds of the height of the planar portion. Flange 12' is positioned at right angles to the planar portion 2'.

The right side of an adhesive spreader is also depicted in FIG. 3 comprising a rectangular planar portion 2' having serrations 4' in its lower longitudinal edge, and a circular aperture 18 arranged about two-thirds of the height of the planar portion. Flange 14' is positioned at right angles to the planar portion 2'.

The adhesive spreader is assembled with the slot 16 and the aperture 18 aligned. Furthermore, an optional clamping member 20 is located over the aperture 18 and a bolt 22 can then be located through the aperture 24 on one side of the clamping member 20, through the aperture 18 through the slot 16 to a nut 26 which is screwed onto the stem of the bolt and turned until the clamping member is firmly in abutment with the planar portion and the relative movement between the portions is restrained such that the width of the assembled adhesive spreader is fixed to a single or a multiple tile width. The bolt and nut can be fitted on respectively opposite sides.

Figure 4:
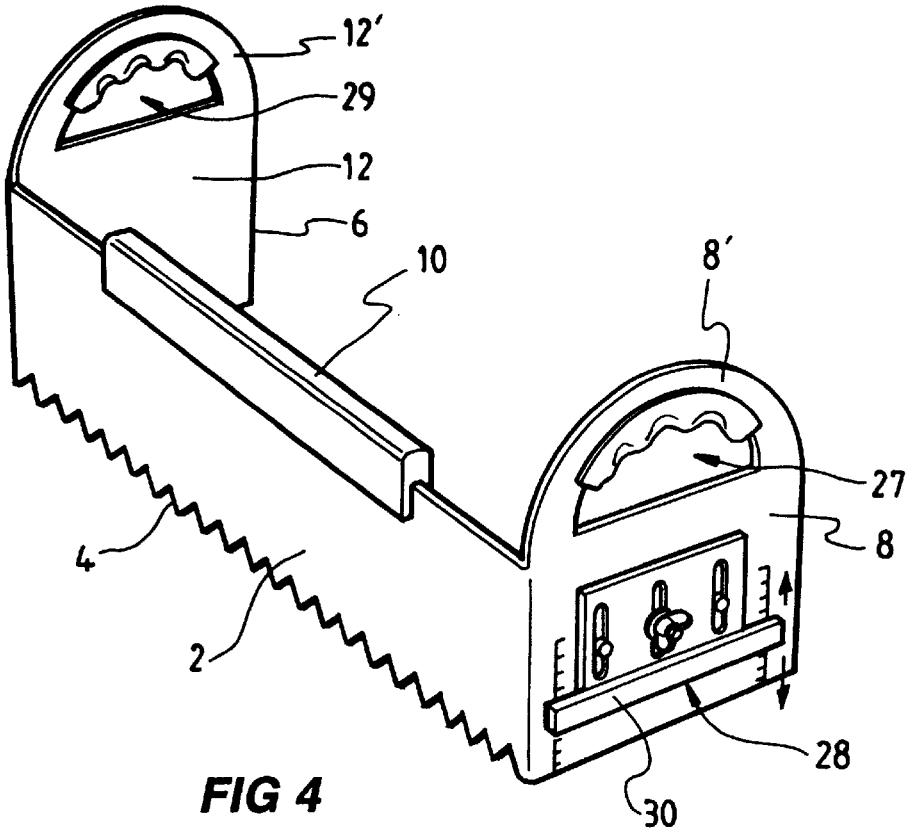
FIG. 4 depicts a further embodiment of an adhesive spreader which can be arranged to provide a level bed of adhesive.

FIG. 4 depicts the embodiment of FIG. 1 having a height adjustment means on flange 8. An embodiment of the height adjustment means is shown in greater detail in FIGS. 5 and 6. FIG. 4 also depicts alternative or additional handles 8' and 12' located above the respective upper surfaces of flanges 8 and 12. The handles depicted are formed by extending the flange walls (8 and 12) upwards sufficiently so as to provide an aperture 27 and 29 respectively. The section of the handles 8' and 12' gripped by the user can be shaped or additional grip improving material such as foam or ABS plastic material can be attached so as to form an ergonomically acceptable hand grip, but one example of such arrangement is depicted in FIG. 4.

A height adjustment means is preferably provided so as to allow the maximum height of the spread adhesive to be adjustable. In the embodiment depicted, this is achieved by providing a gauge surface 28 which is adjustable against the height of the flange 8. The gauge surface can be placed on a surface aligned in height and direction suitable for guiding the spreader and thereby the serrations across the surface to which the adhesive is to be applied.

Regardless of the flatness or otherwise of the surface beneath the adhesive, the gauge surface follows a predetermined consistent height and direction and consequently the maximum height of the adhesive is also of consistent height and direction.

For example, the surface to be tiled may be slightly undulating, but use of an adhesive spreader with a height adjuster and a prepared abutment surface for the gauge surface of the spreader provides a predetermined height of tile adhesive once spread.

If the laid tiles need a slope, the adhesive can be spread with a slope by using a suitable abutment surface and gauge surface.

Figure 5:
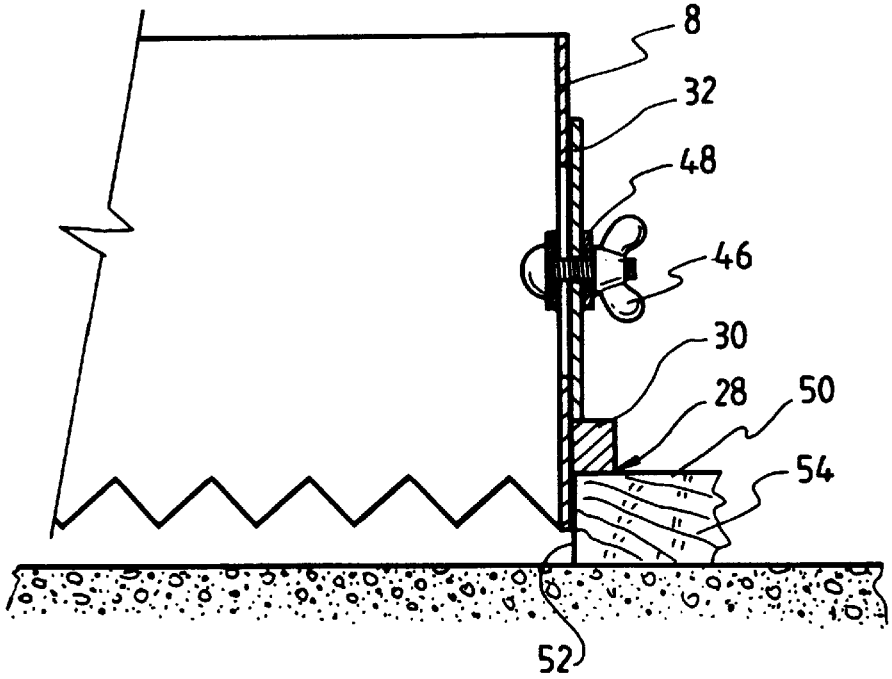
FIG. 5 depicts a side view of the height adjuster means depicted in FIG. 4.

Referring to FIG. 5, the adjustment means comprises in this embodiment a gauge surface 28 formed by a planar elongate surface on the underside of an elongate bar 30. The elongate bar is attached to a plate 32. The plate and bar may in another embodiment be made as a single unit. The plate in this embodiment has three slots 34, 36 and 38 located over three stubs 40, 42 and 44 (all depicted in FIG. 6). The stubs protrude from the outer surface of flange 8. The use of three stubs in this embodiment ensures that the plate 32 only moves up and down against the height of the flange and also maintains the gauge surface parallel with the lower surface of flange 8.

Only one of the stubs need have a clamping arrangement to fix the plate 32 in position relative to the flange 8. In this embodiment, a wing nut 46 is used on the end of stub 42 to force a washer 48 against the plate 32 and in turn against flange 8. It may also be suitable for the wing nut 46 to be used on the end of stub 42 without an intermediate washer 48.

A height adjustment means as described above may be fitted to either of the embodiments described, or others which are within the scope of the invention described herein.

Figure 6:
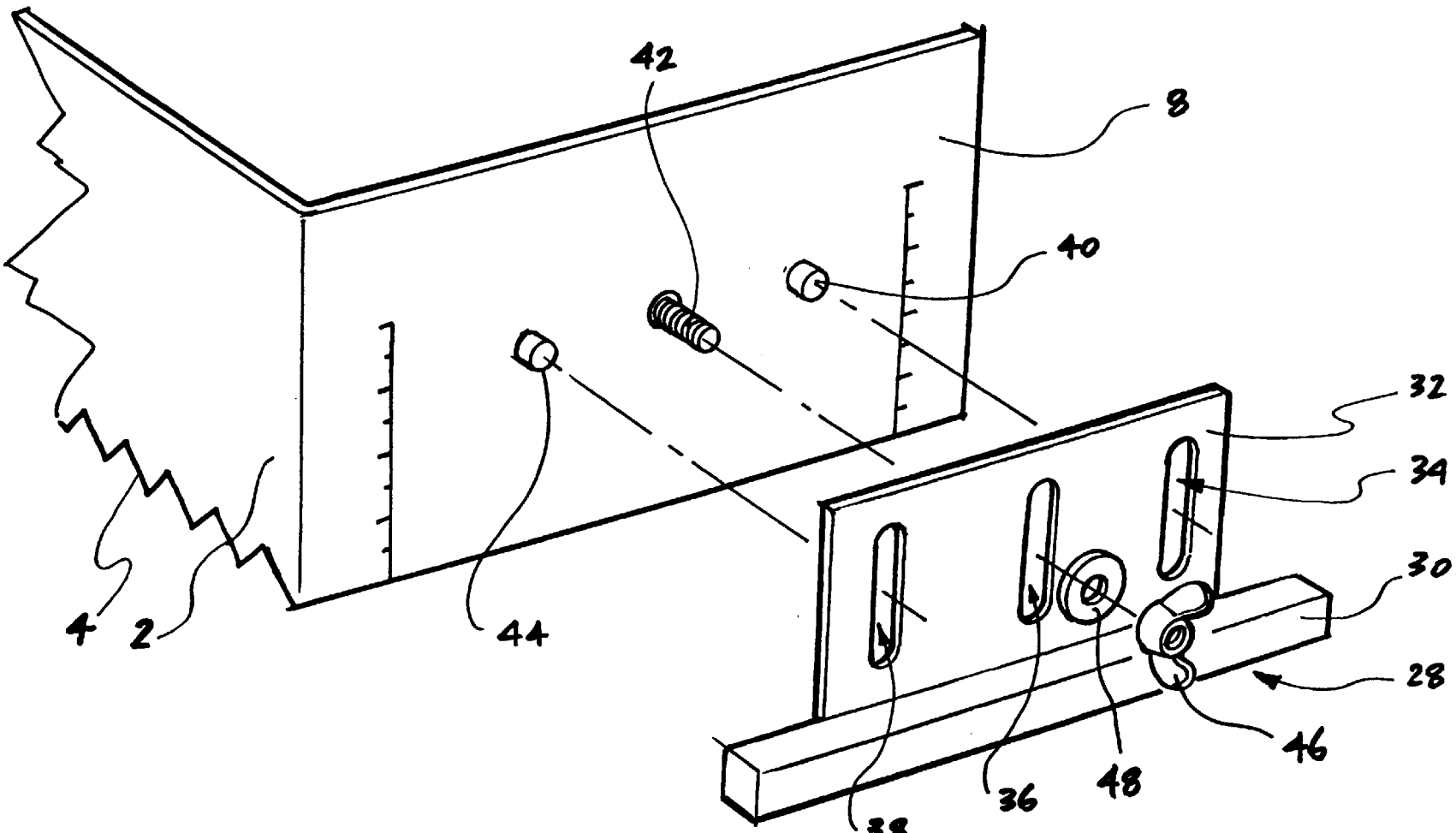
FIG. 6 depicts a detailed "exploded" view of the height adjuster means of the embodiment depicted in FIGS. 4 and 5.

Referring to FIGS. 5 and 6, the gauge surface 28 is then positionable upon a pre-prepared guide surface 50 and further guided by the abutment of the side of the flange 8 against a further prepared guide surface 52.

Typically the guide 54 comprises a straight length of wood, long enough to span the length of three to four tiles laid end on end. The guide is preferably thin and light enough for easy positioning by the tradesperson. Since the width of the tile to be laid plus a grout width is known, the prepared guide can be placed a measured distance from a starting wall or previously laid row of tiles. A guide can be temporarily fixed in position by laying boxes of tiles on or against it or other temporary fixings may be used.

The adhesive spreader (either the non-height adjustable or height adjustable spreader) is then located in abutment with the guide and a quantity of adhesive is placed into the volume partially surrounded by the planar portion 2 and flanges 6 and 8. Sometimes the adhesive may need pushing into the corners of the spreader so as to ensure there is an adequate supply of adhesive adjacent serrations at the side of the spreader.

The spreader is then pulled across the surface to be laid while keeping the flange adjacent the guide, and in doing so adhesive is extruded out of the rear of the spreader via the serrations with a constant height as gauged by the height of the serrations.

The spreader can typically be moved at least two and sometimes three large tile lengths in one sweep before the adhesive reservoir is depleted and requires replenishment.

Once the adhesive has been spread, it is preferable to lay the tiles soon thereafter by simply placing them a spaced distance from the wall and/or a previously laid tile, until all the adhesive spread is covered.

Since the accuracy of laying the adhesive is greater than previous methods, there tends to be much less wastage and cleaning of excess adhesive from adjacent areas. Excess adhesive not in the area to be immediately tiled may harden while other tiles are being laid and thus can cause unwanted hardened undulations on surfaces which are yet to be tiled.

Any slope to the adhesive or underlying prepared surface can be easily accounted for by setting up the guide and any time spent setting up the guide is more than compensated for by the speed of spreading and laying the tiles in a consistent and high quality manner.

Figure 7:
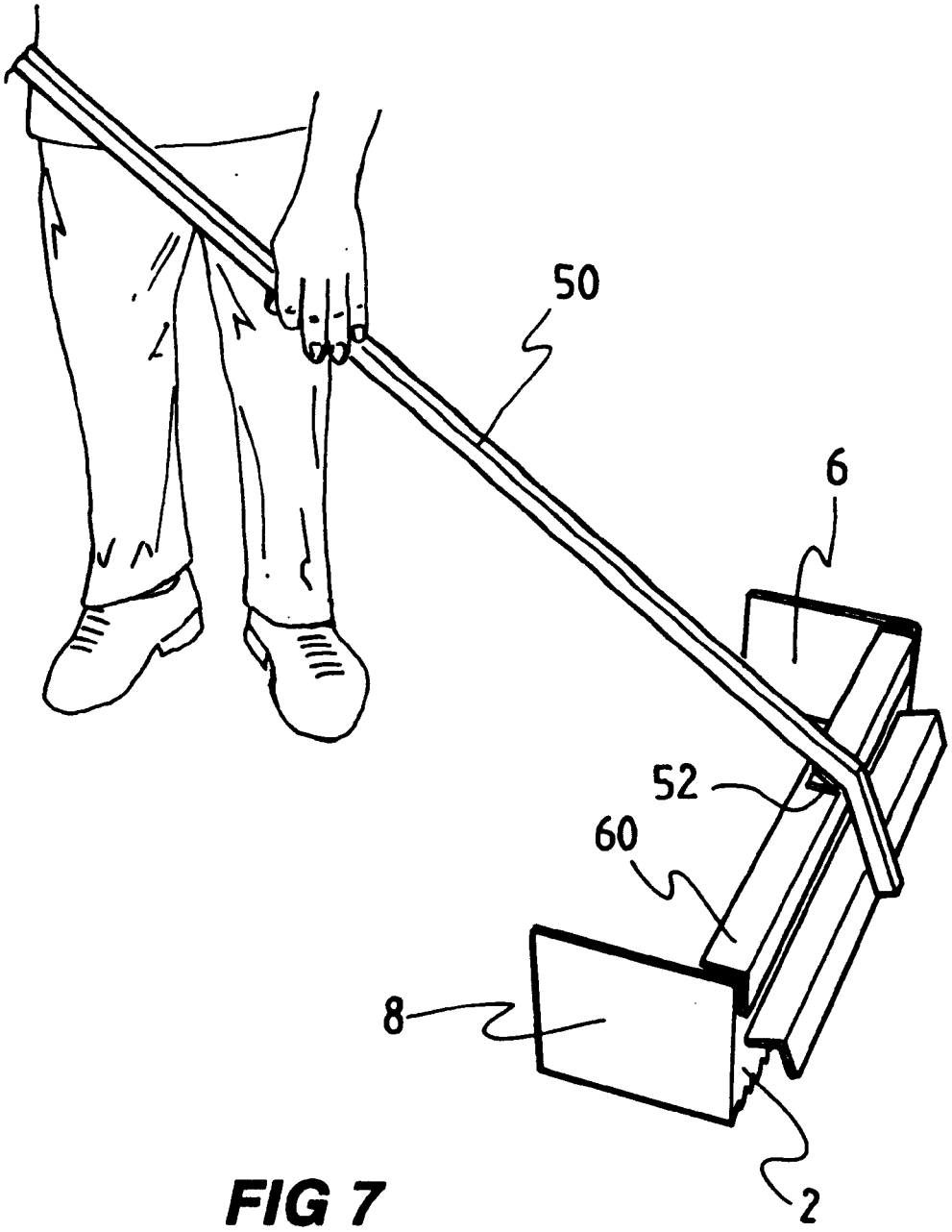
FIG. 7 depicts a perspective view of a handle for use with an embodiment of an adhesive spreader according to the invention.
Figure 8:
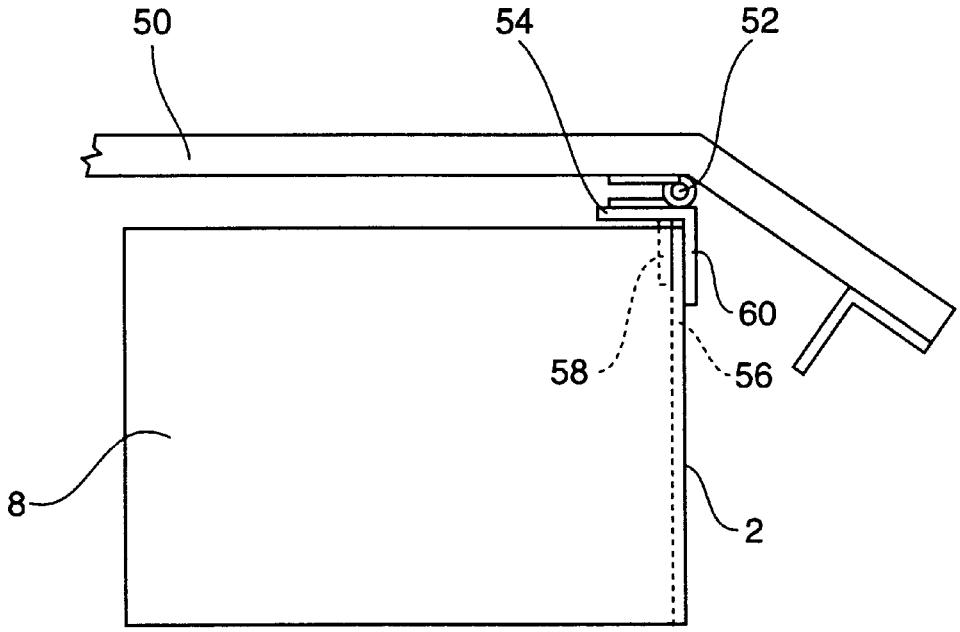
FIG. 8 depicts a side view of the handle in a lowered position.

A further embodiment of the invention comprises an elongate handle 50 as depicted in FIG. 7 arranged so that it can be attached or fitted to the adhesive spreader. In this embodiment it is fitted over the upper surface of the rectangular planar portion 2 so as to project forwardly of the spreader and allow a user to pull or drag the spreader along the surface to be tiled while they are standing or stooping.

Such an arrangement has been found advantageous for people who cannot who do not wish to get down on bended knees to pull or drag the spreader by direct hand contact.

Thus such an arrangement also brings the basic skills of tile laying into the capabilities of non-professional tilers.

There are a number of preferable features of the handle which are described below.

Figure 9:
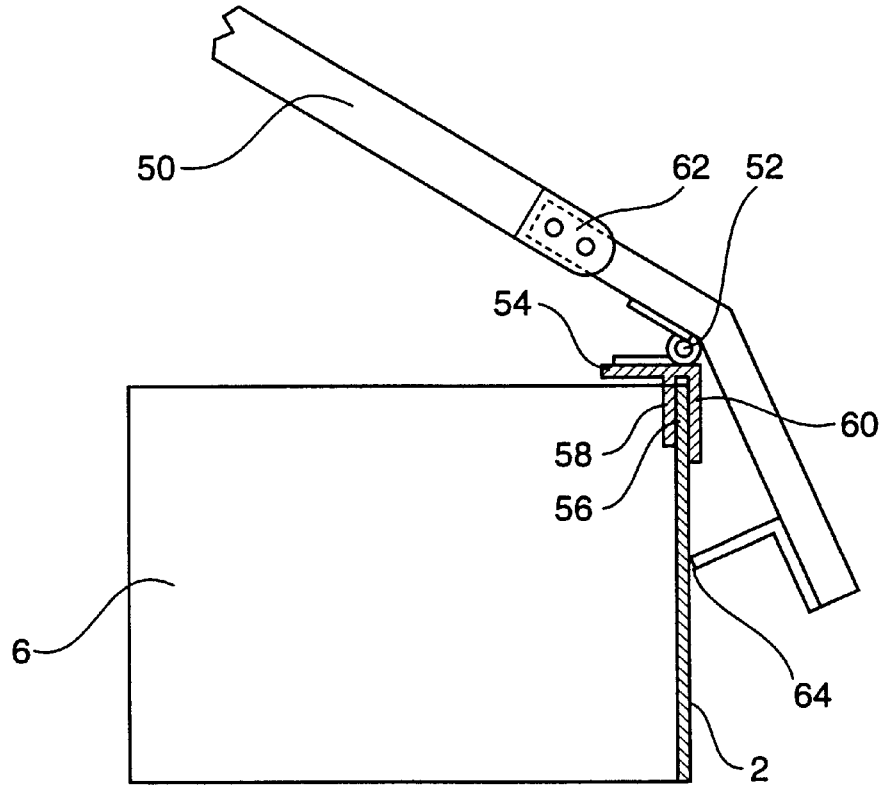
FIG. 9 depicts a side view of the handle in a raised position.

The handle can be hingedly connected to the means to attach the handle to the spreader. A hinge 52 arranged as depicted in FIGS. 7 and 9, allows the handle 50 to be raised, substantially above the planar portion 2 so that the way is clear for a container of adhesive to be brought close to the front of the spreader and poured into the region in front of the planar portion 2 and the flanges 6 and 8 of the adhesive spreader. Further clearance of the handle from the region could be provided by an additional articulation point 62 along the handle shown in FIG. 9 only or other arrangement.

The hinge 52 may be located anywhere forward, above or at the rear of the planar portion 2.

In this embodiment the handle is hinged to a plate 54 which is above the planar portion 2 and orientated at right angles to the planar portion 2. A channel 56 with walls 58 and 60 is formed on the plate 54. The rearward wall 60 being longer than the forward wall 58 to assist the fitting of the channel 56 on to the planar portion. The channel is also sized so as to fit snugly over the top portion of the planar portion 2 of the adhesive spreader and may be made of parts rather than from a unitary piece of material.

The attachment means is of less width than the planar portion 2 of the spreader and can be made to fit over any of the planar portions of the various embodiments described.

Once fitted and the adhesive located forward of the planar portion, the spreader tool can be pulled or dragged by the handle 50 from a standing position so as to spread the adhesive in the manner previously described.

The pivotable end of the handle is shown extending rearward of the planar portion 2 of the adhesive spreader and shaped to abut the rear of the planar portion 2 when the handle is raised to a predetermined angle. In the uppermost raised position the handle is in a comfortable position for the user to pull the spreader tool along the floor as well as abutting 64 the rear of the planar portion 2.

The channel 56 provides for a firm downwards pressure to be applied to substantially the full width of the planar portion 2 while the handles' abutment at a relatively lower point along the rear of the planar portion 2 ensures that the pulling force is nearer the centre of gravity of the spreader and the adhesive to be spread than if the handle was not extended to the rear of the planar portion.

It will be appreciated by those skilled in the art that the invention is not restricted in its use to the particular application described and neither is the present invention restricted in its preferred embodiments with regard to the particular elements and/or features depicted herein. It will be appreciated that various modifications can be made without departing from the principle of the invention, therefore the invention should be understood to include all such modifications within its scope.

What I claim:

1. A spreader tool for spreading a viscous liquid material over an underlying surface, comprising:

a rectangular planar portion forming a rear wall having a plurality of indentations along a lower longitudinal edge, a pair of opposing side walls extending substantially at right angles from the rear wall, wherein said side walls provide a sideways barrier for a mass of viscous liquid material lying in front of said rear wall such that as the spreader tool and viscous liquid material are drawn across said surface a supply of viscous liquid material is spread over said surface as it flows through said indentations, providing an even application of viscous liquid material across the full width of the spreader tool, and a height adjuster device comprising a gauge surface adjustable up and down the height of at least one of said side walls such that when said gauge surface is located on a guide located adjacent said surface to be tiled, said spread viscous material having a maximum height which is a predetermined distance from said gauge surface.

2. A spreader tool in accordance with claim 1 wherein said side walls are shaped so as to maintain said rear wall upright thereby providing a level upper surface to said spread viscous material.

3. A spreader tool in accordance with claim 1 wherein said indentations are triangular in shape so as to provide a saw tooth upper profile on an upper surface of said spread viscous material.

4. A spreader tool in accordance with claim 1 wherein said height adjuster device is fitted to both said side walls so that the maximum height of said spread viscous material can be set for each side of said spreader tool.

5. A spreader tool in accordance with claim 1 further comprising an elongate handle pivotably connected to said spreader tool and movable so as to in a raised position allow viscous material to be placed between said rear wall and opposed side walls and in a lowered position is useable to draw said spreader tool across said floor surface.

6. A spreader tool for spreading a viscous liquid material over an underlying surface, comprising:

a rectangular planar portion forming a rear wall having a plurality of indentations along a lower longitudinal edge, a pair of opposing side walls extending substantially at right angles from the rear wall, wherein said side walls provide a sideways barrier for a mass of viscous liquid material lying in front of said rear wall such that as the spreader tool and viscous liquid material are drawn across said surface a supply of viscous liquid material is spread over said surface as it flows through said indentations, providing an even application of viscous liquid material across the full width of the spreader tool, and wherein said rectangular planar portion forming said rear wall is formed by at least two parts which are movable with respect to one another to adjust the width of said spreader tool.

* * * * *